United States Patent [19]

Adams

[11] Patent Number: 4,893,568

[45] Date of Patent: Jan. 16, 1990

[54] RAILWAY CAR CONVERSION TO GONDOLA CAR

[75] Inventor: Norman S. Adams, Cincinnati, Ohio

[73] Assignee: Trinity Industries, Inc., Dallas, Tex.

[21] Appl. No.: 129,799

[22] Filed: Dec. 7, 1987

[51] Int. Cl.[4] ..... B61D 17/10

[52] U.S. Cl. ..... 105/416; 105/370; 105/248; 105/409; 105/419; 105/406.1; 105/422

[58] Field of Search ..... 105/248, 406.1, 413, 105/416, 419, 420, 422, 243, 239, 355, 404, 409, 411, 463.1, 333, 370, 413, 414, 418, 332, 370, 371, 372

[56] References Cited

U.S. PATENT DOCUMENTS

| | | | |
|---|---|---|---|
| 673,103 | 4/1901 | Williamson et al. | 105/248 |
| 4,254,714 | 3/1981 | Heap | 105/419 |
| 4,361,097 | 11/1982 | Jones et al. | 105/409 |

*Primary Examiner*—Andres Kashnikow
*Assistant Examiner*—Mark T. Le
*Attorney, Agent, or Firm*—John J. Kowalik

[57] ABSTRACT

A hopper car is converted to a gondola-type car by replacing the hoppers and their dump doors with a light metal sheet floor. The floor sheets form a series of box-like compartments. The compartments are formed by crossbearer partitions extending between the side walls, center sill and the sheet floor. Floor frame members reinforce the rigidity of the floor structure. The partitions are formed by tubular crossbearers on gussets on the center sill, and closure walls converging at the top thereof.

13 Claims, 2 Drawing Sheets

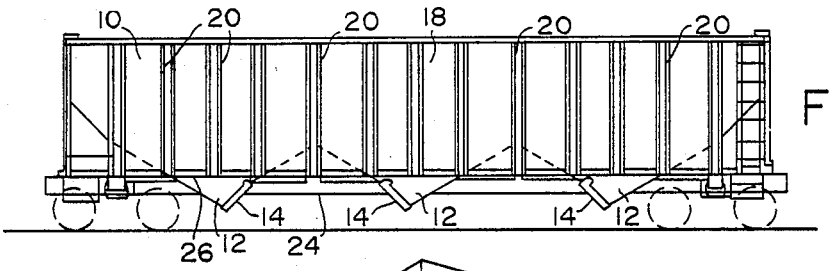
FIG. 1
FIG. 2
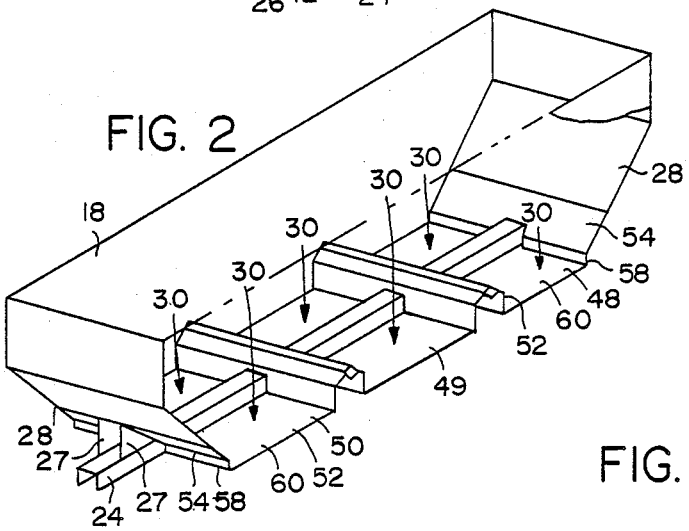
FIG. 3
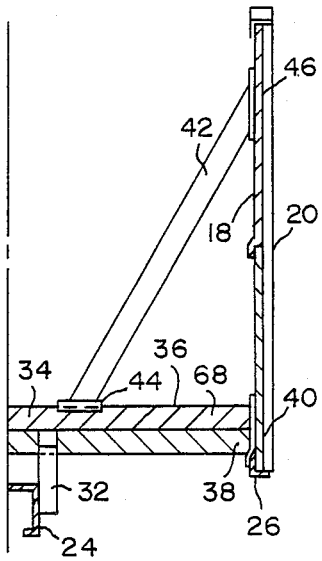
FIG. 4
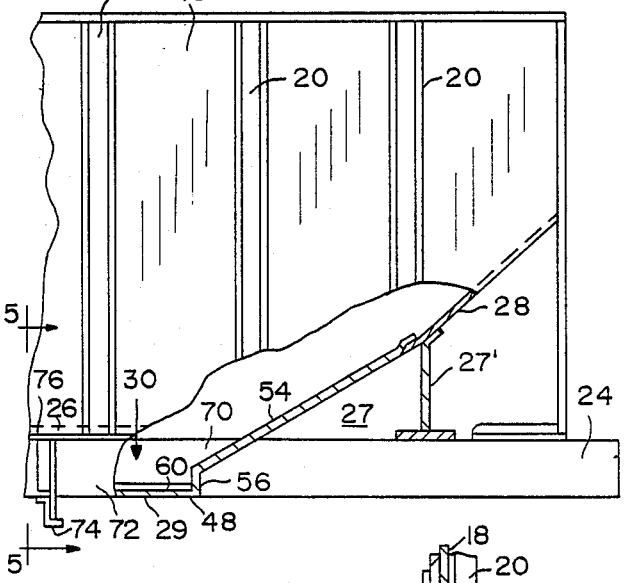
FIG. 5
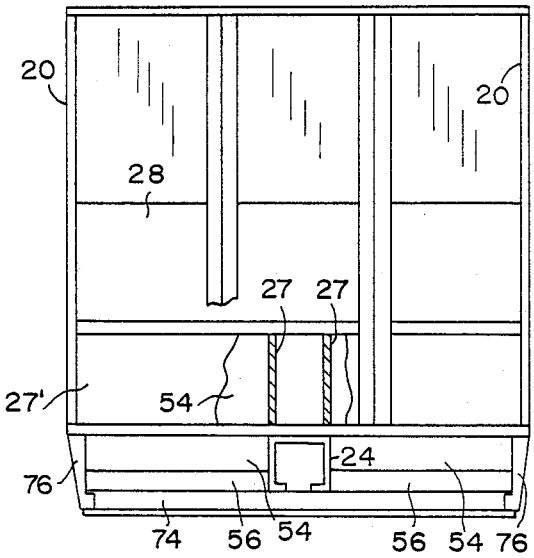
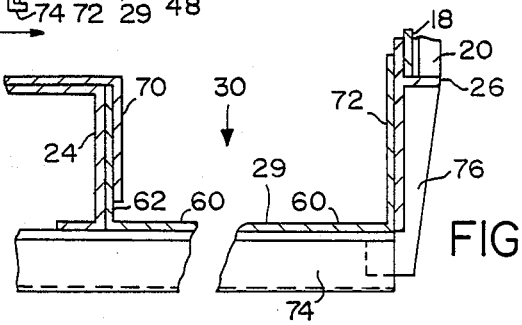
FIG. 6

RAILWAY CAR CONVERSION TO GONDOLA CAR

BACKGROUND OF THE INVENTION

1. Field of the Invention

This invention pertains to railroad cars, and more particularly to railway cars being converted to gondola-like cars for rotary dumping of bulk granular freight such as coal.

2. Description of the Prior Art

Railway cars are often provided with hoppers and dump doors in the floor structure thereof to aid in off loading cargo from the car. For example, the U.S. Pat. No. 3,595,175 issued to R. J. Austill, discloses a hopper box freight carrier adapted for transporting freight in granular form.

Gondola cars are railway car provided with a sealed bottom, and are unloaded by rotary dumping, i.e. dumping the freight by turning the car upside down.

The hoppers, dump doors, and associated door control systems of a hopper car are generally made of heavy steel components, and the multiple moving parts are expensive to manufacture require maintenance and adjustment. Repeated use of the car and the possibly corrosive nature of the lading may cause a deterioration in the load containing envelope of the car over time, necessitating replacement of part or all of the load containing envelope. Structures supporting the hopper components are also heavy. It is one of the objects of the subject invention to reduce the weight of a car by doing away with such structures.

It is possible to reduce maintenance problems of hopper cars by welding the dump door shut and employing rotary dumping to unload the car. However, in that case all of the hopper structures and related components are carried as unnecessary weight. The subject invention resolves that the problem by stripping the bottom of the hopper car of all hoppers and replacing it with a unitary lightweight structure.

None of the references of record describes or teaches the novel structure and method of the subject invention being described in greater detail hereinbelow.

SUMMARY OF THE INVENTION

According to the present invention, a railway hopper car with several hoppers and respective dump doors is converted to a gondola-type car.

The bottom structure of the hopper car is removed, leaving the center sill, side sills, sloping end walls, transverse bolsters, and slope sheet bolster plates, all of which are of steel. In the case of replacement of the entire load containing envelope, the side walls and sloping end walls are also removed. Tubular aluminum crossbearers are placed in the car extending between plates bolted to the side walls. The crossbearers are supported on aluminum gussets bolted to the center sill. Aluminum floor sheets are then connected as by bolts to the sloping end walls and to the side sills and connected to the crossbearers. A center sill cover sheet may be connected to the floor sheets on either side of the center sill to cover, the center sill to protect it from possibly corrosive lading. Support brackets depending from the side sills are secured to the car, and a support bean is secured to the brackets and the center sill to extend below and support the floor sheets. The resulting car comprises a sealed floor, crossbearer partitions attached to the center sill and side walls. The floor formed by the light metal floor sheets and divided by the center sill and crossbearer partitions to form box-like cells. The cells are supported by floor frame members and by the crossbearers.

DESCRIPTION OF THE DRAWINGS

FIG. 1 is a side view of a conventional hopper car with hopper dump doors which is a candidate car for the structural body replacement and/or conversion of this invention;

FIG. 2 is a perspective view of a hopper car converted to a gondola-type car with a portion of the side walls cut away to show the cells of the floor structure;

FIG. 3 is a partial sectional view of a converted car with the floor structure removed to illustrate crossbearer connection to the car side wall and the center sill;

FIG. 4 is a partially cutaway side view of the car shown in FIG. 2 showing the floor structure adjacent the end of the car;

FIG. 5 is an enlarged cross-sectional view of the car of FIG. 2 taken substantially along the line 5—5 in FIG. 4;

FIG. 6 is an end view of the converted car shown in FIG. 2;

DESCRIPTION OF THE PREFERRED EMBODIMENT

Figure 7:
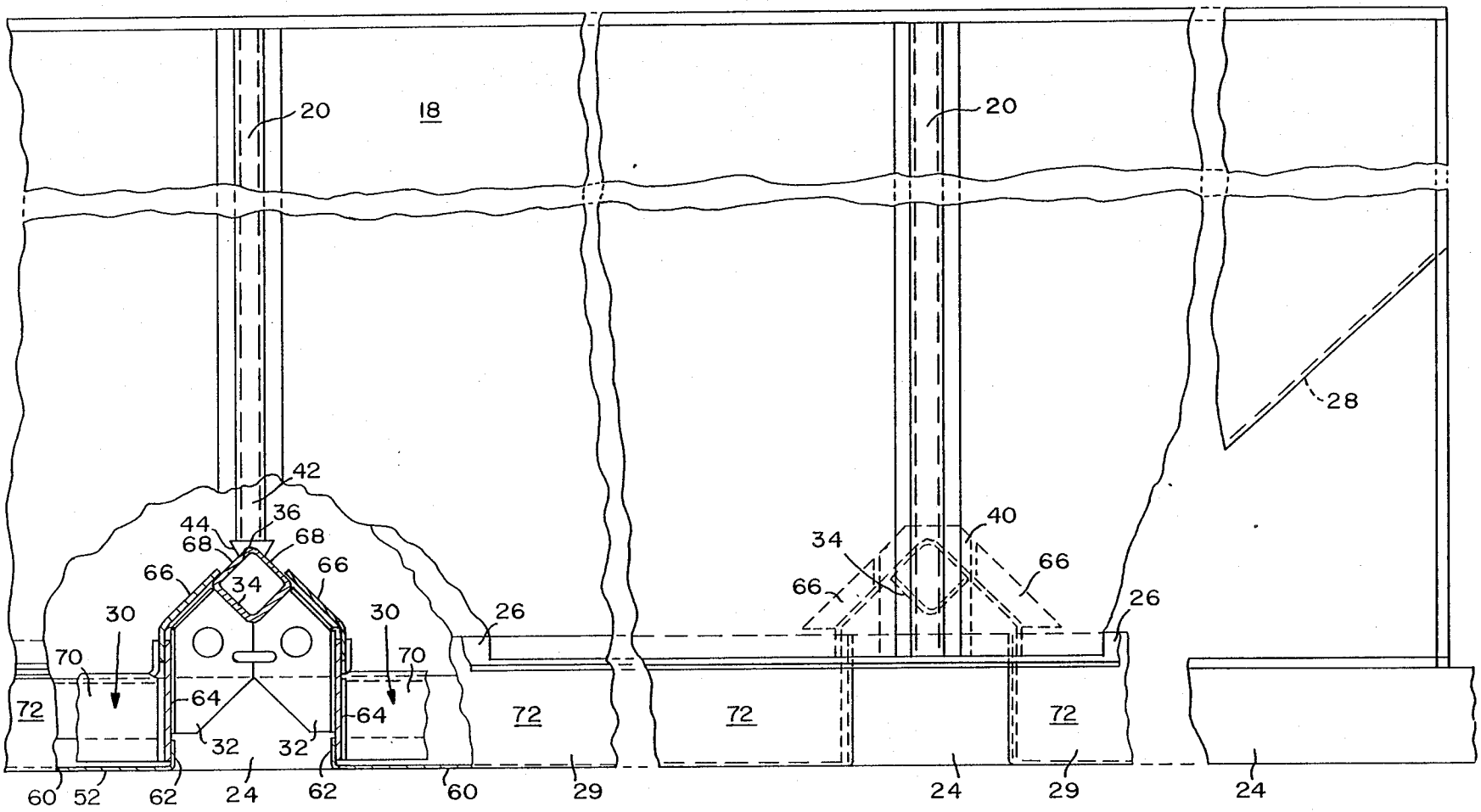
FIG. 7 is an enlarged elevational view of the car with portions of the side wall cut away to show the crossbearer and floor structures.

Referring now to the drawings wherein like reference characters designate corresponding parts throughout the several views, there is shown in FIG. 1 a conventional hopper car 10 having three hoppers 12 with respective dump doors 14. Car 10 includes side walls 18 with vertical reinforcing posts 20 having a hat-like configuration in crossection. Through the method of this invention these hoppers 12 and door 14 are removed and replaced with structure to convert the hopper car to a gondola car.

In the conversion method of the present invention, the hoppers 12 and related structures, such as the dump doors 14, are removed from the car 10, eliminating the floor structure of the hopper car 10 except for the center sill 24, the side sills 26, triangular bolster plates 27, transverse bolster beam 27', and sloping end walls 28. A new floor structure generally indicated at 29 in FIG. 6 is applied to the car which interconnects the center sill 24, the side sills 26, and end walls 28 by aluminum sheets to form box-like floor cells 30.

After the hopper 12 and related structures are removed, aluminum gussets 32 are secured to the steel center sill 24 by securing means such as bolts (not shown) 33. Laterally extending aluminum tubular crossbearers 34 are supported on gussets 32. The tubular crossbearers 34 are generally square in crossection, and have an upper edge 36 pointed upwardly to form an apex or ridge. The pointed top of the partition guides freight deposits into the adjacent compartments. The lateral ends 38 of crossbearers 34 are each secured, as by welding, to a respective aluminum connection plate 40 secured to the steel side sill 26 and side wall 18 by securement means such as bolts or rivets.

As shown in FIG. 3, diagonal braces 42 extend between the crossbearer 34 and side walls 18 to buttress the side walls 18. Each crossbearer 34 supports a pair of braces 42, each brace 42 supporting a respective side wall 18. Each brace 42 includes brace end pad 44 which connects the brace 42 to the crossbearer 34. The opposite end of brace 42 includes plate 46 which is secured to the respective side wall 18.

After crossbearers 34 are secured within the car 10, the aluminum sheet members which form the floor structure 29 are applied to the car.

As best shown in FIG. 2, the two crossbearers 34 divide the floor structure 29 into a first longitudinal end segment 47, a middle segment 49, and a second longitudinal end segment 50.

The sheets 52 of the floor structure 29 in longitudinal end segments 48 and 50 include slope portion 54 which are attached to sloping end walls 28 of the car 10. Slope portion 54 overlie triangular bolster plates 27 which are retained from the original hopper car structure. Slope portion 54 extends downwardly around center sill 24 to connect with a generally vertical bend portion 58 on each side of the center sill 24. Bend portion 58 extends downward from slope portion 54 to approximately the level of the bottom of center sill 24 where bend portion 58 meets floor portion 60. Floor portion 60 extends substantially horizontally from bend portion 58 to form the bottom of the floor structure 29. The structural combination of slope portion 56, bend portion 58, and floor portion 60 forms a rigidifying beam structure at the outward ends of cells 30 of end segments 48 and 50. This beam structure aids in support of loads created by lading resting on floor portion 60.

Floor portion 60 is connected with upwardly extending flange portion 62 adjacent center sill 24 and crossbearer 34. Flange portion 62 is connected to vertical wall member 64 as by welding. Wall member 64 is connected to crossbearer slope plate 55, which is welded to one of the upper walls 68 of crossbearer 34.

Center sill cover plate 70 overlies the center sill 24 and is attached to the side walls of the center sill 24 and to the flange portion 62 of the sheet on each lateral side of the center sill 24. The cover plate 70 protects the center sill 24 from possible corrosion from the lading.

Floor portion 60 is connected at its laterally outward edge to cell side wall portion 72 which is connected as by bolts or rivets (not shown) to the respective side sill 26 and side wall 18.

The sheet in the middle segment 49 of the car is connected to the two crossbearers 34, and has no slope portion. As best shown in FIG. 7, the connection structure securing the middle segment sheet to each of the crossbearers 34 is substantially the same as the connection of the inward ends of the end segment sheets to the crossbearer 34, and the same reference numbers are used for like parts in the figures.

The sheets 52 form a depressed bottom to the car 10. Loads on the sheets 52 are transmitted to the center sill 24, the side sills 26, end walls 28, and to the crossbearer 34. Lading loads applied to the crossbearer 34 are transferred laterally to the center sill 24. The loads create a torsion in the crossbearer 34 which is transferred through gussets 32 to the center sill 24. The tubular structure of the crossbearer 34 makes it well-suited to this transfer of load.

The bottom sheets 52 are supported by Z shaped support members 74 which are secured to the center sill 24 and to the side sills 26 via vertical angle brackets 76 best shown in FIG. 5, which brackets 76 are welded to the side sills. The frame formed by Z-beams 74 and vertical angle brackets 76 extends below the cells 30 and reinforces the floor structure to support cargo loads.

The conversion to a gondola car may be accomplished without installation of tubular crossbearers 34 by leaving the original crossbearers in the car. These crossbearers are generally in the form of a modified I-beam having a horizontal bottom flange secured to the top of the center sill 24, a laterally extending vertical web wall, and an inverted V-shaped upper flange. The V-shaped upper flange comprises two angulated flanges sloping downward from the web. In the alternative conversion, the aluminum crossbearer slope plates 66 are secured, as by bolts or rivets, to the angulated upper flanges of the I-beam crossbearer. Use of the original crossbearer reduces the amount of labor involved in the conversion, although less weight is saved, due to the fact that the I-beam crossbearer is made of steel.

The subject invention results in the reduction of about 800 pounds of weight which reduces the energy needed to move the car, and reduces the cost of shipping. Over the life of the car, this makes the cost of conversion economically desirable. Without quite as significant a weight savings, steel may be used instead of aluminum in the parts described herein.

While the preferred embodiment is directed toward conversion of a hopper car, the instant invention may be used to secure similar benefits in a variety of types of railway cars.

While one embodiment of the invention has been illustrated and described herein, various changes and modifications may be made therein without departing from the spirit of the invention as defined by the scope of the appended claims.

What is claimed is:

1. A railway car comprising:

a generally longitudinally extending center sill and laterally spaced pair of side walls;

said side walls each including a side sill;

a crossbearer structure positioned above said center sill and extending between the side walls;

a floor extending between the side walls and being connected with the crossbearer structure in a manner that substantially covers the cross bearer structure; and a floor frame structure connected with the side sills and extending below and engaging the floor for supporting and rigidifying the floor, said floor frame structure comprising substantially straight support members extending from one side wall to the other side wall transversely of the center sill, beneath said floor and center sill and in engagement therewith along a substantially flat surface.

2. The invention as claimed in claim 1 and said frame structure comprising a pair of brackets each connected with a respective side sill and depending therefrom, and said support members being connected at their ends with respective brackets and extending therebetween below the floor structure for reinforcement thereof.

3. The invention as claimed in claim 2 and center sill supported between the said side walls; and said support members being fixedly connected with said center sill and said support members being quadrilateral and of substantially constant transverse dimension from end to end.

4. The invention as claimed in claim 2, and said support members comprising generally Z-shaped beams connected with said brackets, and said cross bearers being spaced above said center sill and extending between said side walls and connected thereto.

5. The invention according to claim 1, and said floor forming depressed cargo compartments below the level of the side sills.

6. A railway car comprising:

first and second laterally spaced side walls and a center bolster extending generally longitudinally with respect to the car;

a floor structure connected with the side walls and extending therebetween to support lading in the car;

an end wall supported between the side walls and extending generally downwardly adjacent the longitudinal end of the car;

said floor structure including an end portion fixedly connected with said end wall and extending downwardly therefrom, said end portion having a lower end;

bend portion connected with the lower end of the end portion and angulated with respect thereto to extend downwardly therefrom;

a bottom portion connected with the lower end of the bend portion and extending generally horizontally therefrom to form with the bend portion and the end portion, a beam structure for reinforcing the bottom portion and engaging therewith along flat areas to support lading loads, said bottom portion extending at the level of the bottom edge of the center bolster, and said beam structure disposed in supporting relation to said bottom portion and extending transversely beneath the center sill and connected thereto and cross bearers positioned above the center bolster and being substantially covered by said bottom portion.

7. The invention according to claim 6, and said end wall and said end portion extending generally slopingly downwardly and longitudinally inwardly of the car; and said bend portion extending generally vertically and laterally of the car whereby said beam structure is a modified Z-shaped beam.

8. The invention according to claim 6, and said end wall, said bend portion, and said bottom portion being formed integral with each other, and said cross-bearers spaced above said center bolster and extending transversely thereof and having depending brackets connecting each crossbearer to the center bolster therebelow.

9. A railway car for transport of freight and configured for rotary dumping of said freight, said railway car comprising:

a pair of laterally spaced side walls including side sills;

a center sill extending generally longitudinally between the side walls;

a crossbearer structure supported on said center sill and extending generally laterally between the side walls and connected thereto and to the side sills;

a floor structure substantially covering the cross bearer structure, connected with the center sill and extending between the side sills to form a bottom of the car for supporting the freight therein;

said crossbearer structure being connected with the floor structure laterally outwardly from the center sill for laterally transferring torsional loads created in said crossbearer structure to the center sill; substantially straight support members transversely disposed beneath the center sill for supporting and engaging the floor structure along a substantially flat surface of the floor structure.

10. The invention according to claim 9, and said cross bearer structure including first and second wall portions angulated with respect to each other and together forming a generally upwardly disposed ridge on said crossbearer structure to protect the crossbearer structure during loading of freight into the car.

11. The invention according to claim 9, and gusset members supported on the center sill and extending upwardly therefrom to support the cross bearer structure.

12. The invention according to claim 9, and said cross bearer structure having lateral terminal ends;

a pair of connection members secured to the ends of the crossbearer structure and to the side walls for securing the crossbearer structure in the car.

13. The invention as claimed in claim 9, and inclined braces interconnecting said crossbearer structure with said side walls.

* * * * *